US006539787B1

(12) United States Patent
Murai et al.

(10) Patent No.: US 6,539,787 B1
(45) Date of Patent: Apr. 1, 2003

(54) GLOW PLUG HAVING A COMBUSTION PRESSURE SENSOR

(75) Inventors: Hiroyuki Murai, Anjo (JP); Kouichi Hattori, Ichinomiya (JP)

(73) Assignee: Denso Corporation, Aichi (JP)

( * ) Notice: Subject to any disclaimer, the term of this patent is extended or adjusted under 35 U.S.C. 154(b) by 67 days.

(21) Appl. No.: 09/695,848

(22) Filed: Oct. 26, 2000

(30) Foreign Application Priority Data

Oct. 28, 1999 (JP) ..... 11-307491

(51) Int. Cl.[7] ..... G01L 7/00

(52) U.S. Cl. ..... 73/119 R; 73/35.12; 73/115

(58) Field of Search ..... 73/35.01, 35.03, 73/35.06, 35.07, 35.12, 35.13, 112, 115, 116, 117.2, 117.3, 119 R; 340/438, 439

(56) References Cited

U.S. PATENT DOCUMENTS

| | | | | |
|---|---|---|---|---|
| 4,425,692 | A | 1/1984 | Minegishi et al. | |
| 6,411,038 | B2 * | 6/2002 | Murai et al. | 123/435 |
| 2001/0008090 | A1 * | 7/2001 | Murai et al. | 73/756 |
| 2001/0015402 | A1 * | 8/2001 | Murai et al. | 248/554 |

FOREIGN PATENT DOCUMENTS

| | | |
|---|---|---|
| EP | 0933342 A2 | 1/1999 |
| JP | 59-60237 | 4/1984 |
| JP | 59-85932 | 5/1984 |
| JP | 4-57056 | 5/1992 |
| JP | 7-139736 | 5/1995 |
| JP | 9-72811 | 3/1997 |
| WO | WO 97/09567 | 3/1997 |

* cited by examiner

*Primary Examiner*—Eric S. McCall
(74) *Attorney, Agent, or Firm*—Nixon & Vanderhye PC

(57) ABSTRACT

A gas tight and simplified glow plug includes a combustion pressure sensor. The plug main body includes a cylindrical housing to be mounted in an engine head with one end side positioned at a combustion chamber side of the engine head. A cylindrical sheath tube is held in the housing with one end side exposed from the one end of the housing. A heating coil is received and held in the sheath tube. A central shaft acts as a rod-like electrode having one end side received in the sheath tube and an other end side exposed from other end of housing. An internal surface of the housing and an external surface of the sheath tube are secured together without forming a substantial

18 Claims, 5 Drawing Sheets

GLOW PLUG HAVING A COMBUSTION PRESSURE SENSOR

CROSS-REFERENCE TO RELATED APPLICATION

The present invention is related to Japanese patent application No. Hei. 11-307491, filed Oct. 28, 1999; the contents of which are incorporated herein by reference.

FIELD OF THE INVENTION

The present invention relates to a glow plug, and more particularly, to a glow plug having a combustion pressure sensor used as an auxiliary starting device for an internal combustion engine, such as a diesel engine or the like.

BACKGROUND OF THE INVENTION

A conventional glow plug is disclosed, for example, in Japanese Unexamined Utility model Publication No. 4-57056. The disclosed glow plug includes a cylindrical housing that is mountable in an internal combustion engine. A sheath (pipe member), which receives a heating element, and a rod-like metal central electrode are held in the cylindrical housing. The heating element is heated up upon energization by the central electrode. A piezoelectric element, which outputs an electric signal, in response to a load (pressure) applied to the sheath in an axial direction of the plug, is also received in an interior of the housing.

Furthermore, an O-ring is disposed between the sheath and the housing in the glow plug. When the axial load is applied to the sheath in response to the pressure developed in a combustion chamber, the sheath slides along the housing via the O-ring. As the sheath slides, the corresponding load is applied to the piezoelectric element, and the electric signal corresponding to the load is outputted from the piezoelectric element. An ignition timing at the combustion chamber is determined based on the electric signal.

In the described prior art glow plug, gas tightness of an interior of the housing solely depends on the O-ring, which allows the slide movement of the sheath relative to the housing, so that combustion gas generated in the combustion chamber could penetrate into the interior of the housing. The penetration of the combustion gas into the interior of the housing results in several problems concerning durability of the glow plug. For instance, these problems may include deterioration of the piezoelectric element due to the high temperature of the combustion gas, disconnection of the heating element due to air-oxidation of the heating element, and leakage of output electrical charge from the piezoelectric element, for example, induced by moisture.

Furthermore, since the piezoelectric element, which constitutes the combustion pressure sensor, is arranged within the housing, the housing needs to have an opening, through which a signal output line of the piezoelectric element is extended out from the housing, and a seal for sealing the opening. This results in a relatively complicated wiring structure for extending the output line of the combustion pressure sensor out of the housing.

SUMMARY OF THE INVENTION

To overcome the aforementioned drawbacks, the present invention provides a glow plug comprising a cylindrical housing mounted in an internal combustion engine, wherein one end side of the cylindrical housing is positioned at a combustion chamber side of the internal combustion engine.

A cylindrical pipe member is held in the housing such that one end side of the pipe member is exposed from the one end of the housing. A heating member is arranged in the pipe member, wherein the heating member is heated up upon energization. A rod-like metal central shaft is received in the housing such that part of the central shaft protrudes from other end of the housing, wherein the central shaft is provided for energizing the heating member. The present invention is characterized in that an internal surface of the housing and an external surface of the pipe member are secured with each other without forming a substantial gap between them at the one end side of the housing. A combustion pressure sensor is arranged around the part of the central shaft, which protrudes from the other end of the housing to measure a combustion pressure in the internal combustion engine based on a force acting on the pipe member upon development of the combustion pressure.

In another aspect of the invention, the combustion pressure sensor is arranged around the part of the central shaft, which protrudes from the other end of the housing. Therefore, the combustion pressure sensor is disposed outside of the housing. As a result, it is not necessary to provide the complicated wiring structure for extending the output line of the combustion pressure sensor out of the housing. As a result, in the glow plug of the present invention, both the gas tightness of the housing interior and the simplification of the wiring structure for the output line of the combustion pressure can be advantageously achieved.

In order to secure the internal surface of the housing and the external surface of the pipe member with each other without forming a substantial gap between them at one end side of the housing, the pipe member can be press fit into the housing, or alternatively, the internal surface of the housing and the external surface of the pipe member can be brazed together.

Further areas of applicability of the present invention will become apparent from the detailed description provided hereinafter. It should be understood that the detailed description and specific examples, while indicating preferred embodiments of the invention, are intended for purposes of illustration only, since various changes and modifications within the spirit and scope of the invention will become apparent to those skilled in the art from this detailed description.

BRIEF DESCRIPTION OF THE DRAWINGS

The present invention will become more fully understood from the detailed description and the accompanying drawings, wherein.

DETAILED DESCRIPTION OF THE INVENTION

Figure 1:
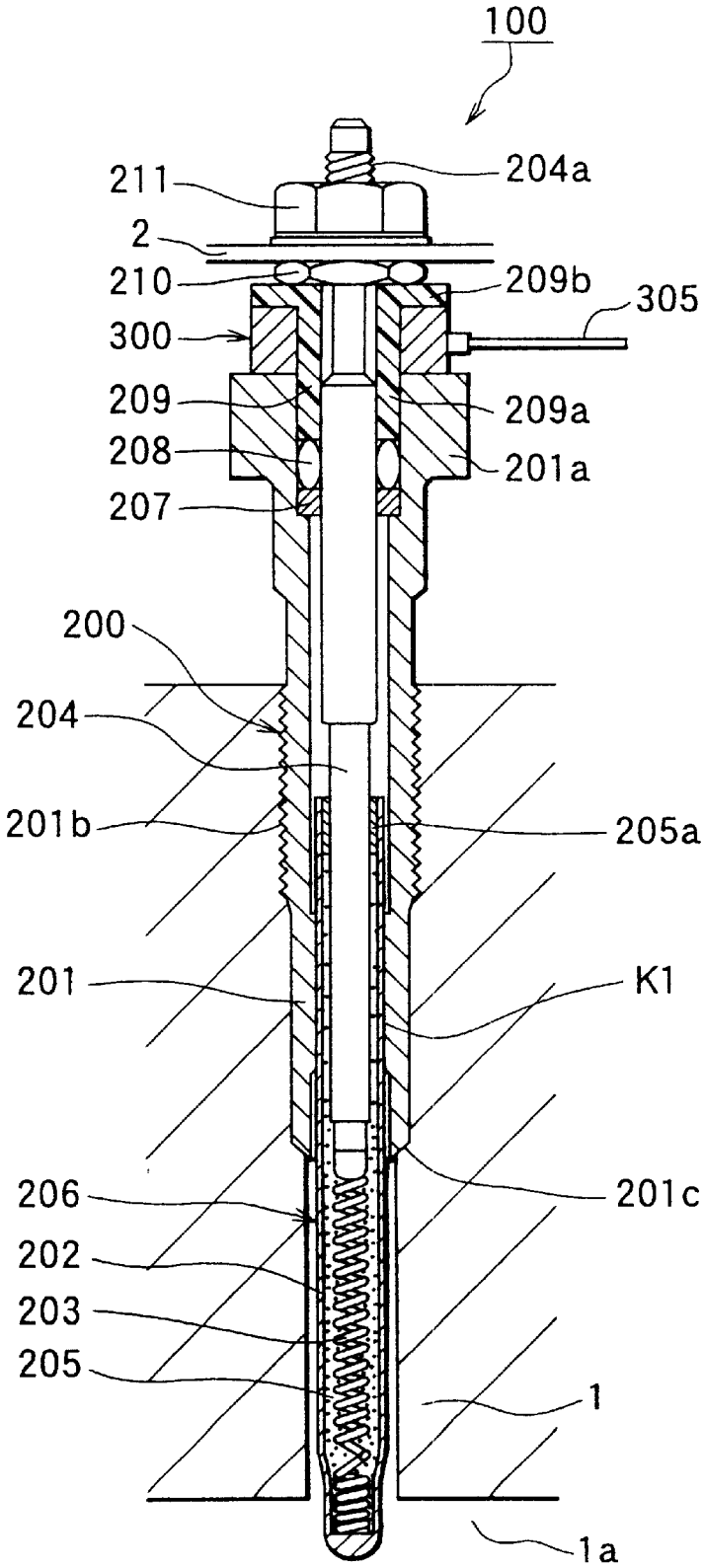
FIG. 1 is a cross-sectional view of a glow plug having a combustion pressure sensor in accordance with a first embodiment of the present invention.

FIG. 1 is a cross-sectional view of a glow plug 100 having a combustion pressure sensor in accordance with a first embodiment of the present invention. The glow plug 100 is mounted in an engine head (receiving member) 1 of a diesel engine (internal combustion engine).

The glow plug 100 has a plug main body 200, which includes a heating unit and acts as a conducting medium for the combustion pressure of the engine, and a pressure sensor 300 (the combustion pressure sensor of the present invention), which acts as a means for sensing the combustion pressure of the engine by converting a force acting on the plug main body 200 upon development of the combustion pressure to a corresponding electrical output signal based on piezoelectric characteristics of a piezoelectric element.

The plug main body 200 includes a metal cylindrical housing 201, which is mounted in the engine head 1 and has one end side (on the bottom side of FIG. 1) positioned on a combustion chamber 1*a* side of the engine head 1. The other end side (on the top side of FIG. 1) is positioned outside of the engine head 1. The plug main body 200 also has a cylindrical sheath tube (the pipe member of the present invention) 202, which has one end side exposed from the one end of the housing 201 and other end side held in the housing 201, a heating coil 203 (the heating member of the present invention), which is received and held in the one end side of the sheath tube 202 and is heated up upon energization, and a rod-like metal central shaft (electrode or rod-like electrode) 204 received in the housing 201 such that one end side of the central shaft 204 is electrically connected with the heating coil 203 and other end side of the central shaft 204 protrudes from the other end of the housing 201.

The engine head 1 has a threaded through hole (glow hole) extending from an external surface of the engine head 1 to an internal combustion chamber 1*a*. The plug main body 200 is threadably inserted into the threaded hole in an axial direction (longitudinal direction) of the plug. By use of a hexagon head section 201*a* and a mounting thread 201*b* provided on an external surface of the housing 201, the plug main body 200 is threadably engaged with and is secured to the threaded hole of the engine head 1. Furthermore, a tapered seat surface 201*c* is formed at the one end of the housing 201. The tapered seat surface 201*c* sealingly engages an opposing seat surface formed in the threaded hole of the engine head 1 to prevent gas leakage from the combustion chamber 1*a*.

The sheath tube 202 is made, for example, of a non-corrosive heat resistant metal alloy material (such as stainless steel SUS 310). A distal end of the one end side of the sheath tube 202, exposed from the one end of the housing 201, is closed. The other end of the sheath tube 202, received in the housing 201, is opened. Furthermore, the heating coil 203 is a resistance wire made of NiCr, CoFe or the like and is received in a distal interior part of the sheath tube 202. One end side of the central shaft 204 is received in an interior of the other end side of the sheath tube 202. One end of the heating coil 203 is electrically connected to the one end of the sheath tube 202, and other end of the heating coil 203 is connected to the one end of the central shaft 204 received in the sheath tube 202.

A heat resistant dielectric powder 205, such as a magnesium oxide powder or the like, is filled in a space between the sheath tube 202 and the heating coil 203 as well as the central shaft 204. The sheath tube 202 is drawn by a swaging process, so that a density (and therefore a heat conductivity) of the dielectric powder 205 is increased, and the central shaft 204 and the heating coil 203 are immovably held by the sheath tube 202 via the dielectric powder 205.

The heating coil 203, part of the sheath tube 202 surrounding the heating coil 203 and the dielectric powder 205 constitute a heating unit 206. The heating unit 206 is securely held within the one end side of the housing 201 while the distal end side (the one end side of the sheath tube 202) of the heating unit 206 is exposed from the housing 201.

The heating unit 206 (an external surface of the sheath tube 202) and an internal surface of the housing 201 are secured with each other by press fitting, brazing (such as silver brazing) or the like. As a result, at the one end side of the housing 201, a secured region K1 is provided where the internal surface of the housing 201 and the external surface of the sheath tube 202 are secured with each other along their entire circumferences without forming a substantial gap between them. The secured region K1 prevents the penetration of the combustion gas from the combustion chamber 1*a* into the interior of the housing 201.

The secured region K1 is a boundary surface between the internal surface of the housing 201 and the external surface of the sheath tube 202. The secured region K1 can be part or all of the boundary as long as it extends the entire circumference of the plug axis. At the other end (open end) of the sheath tube 202, a seal member (sealing) 205*a* is received between the other end of the sheath tube 202 and the central shaft 204 to prevent spill of the dielectric powder 205 from the sheath tube 202 during the swaging process.

A ring-like washer 207 made of a dielectric Bakelite material and an O-ring 208 made of a silicone or fluorine rubber material are received around the other end side of the central shaft 204 within the other end side of the housing 201. The washer 207 is arranged for the purpose of centering the central shaft 204, and the O-ring 208 is arranged for the purpose of achieving the gas and water tightness of the housing 201.

A cylindrical dielectric bush 209 made of a resin material (such as phenol resin) or ceramic (such as alumina) dielectric material is received around the other end side of the central shaft 204. The dielectric bush 209 has a small diameter cylindrical section 209*a*, which extends axially from the interior of the housing 201 to the outside of the housing 201 around the central shaft 204, and a flange-like large diameter section 209*b*, which is formed on an outer end of the small diameter section 209*a*.

A generally annular pressure sensor 300 is arranged around the small diameter section 209*a* of the dielectric bush 209 between the large diameter section 209*b* and the other end surface of the housing 201 (the end surface of the hexagon head section 201*a*). Upon threadably tightening a securing nut 210 onto a terminal thread 204*a* formed on the other end of the central shaft 204, the pressure sensor 300 is securely held between the large diameter section 209*b* of the dielectric bush 209 and the other end surface of the housing 201.

The small diameter section 209*a* of the dielectric bush 209 engages inner circumferential surfaces of the housing 201 and the pressure sensor 300 so as to electrically insulate the central shaft 204 from both the housing 201 and the pressure sensor 300. The O-ring 208 is pressed by the end of the small diameter section 209*a*, opposite to the large diameter section 209*b*, to make more tight contact with the central shaft 204 and the housing 201. This increases the gas and water tightness between the central shaft 204 and the housing 201. The pressure sensor 300 is electrically insulated from the securing nut 210 and the central shaft 204 by the large diameter section 209*b* of the dielectric bush 209.

A connecting bar 2 is secured to the terminal thread 204*a* on the other end of the central shaft 204 by the terminal nut 211 to make electrically connect with the terminal thread 204. The connecting bar 2 is electrically connected to a power source (not shown) and is electrically grounded to the engine head 1 through the central shaft 204, the heating coil 203, the sheath tube 202 and the housing 201. With this arrangement, the heating unit 206 of the glow plug 100 can be heated up and contribute to the ignition and start-up of the diesel engine.

Figure 2:
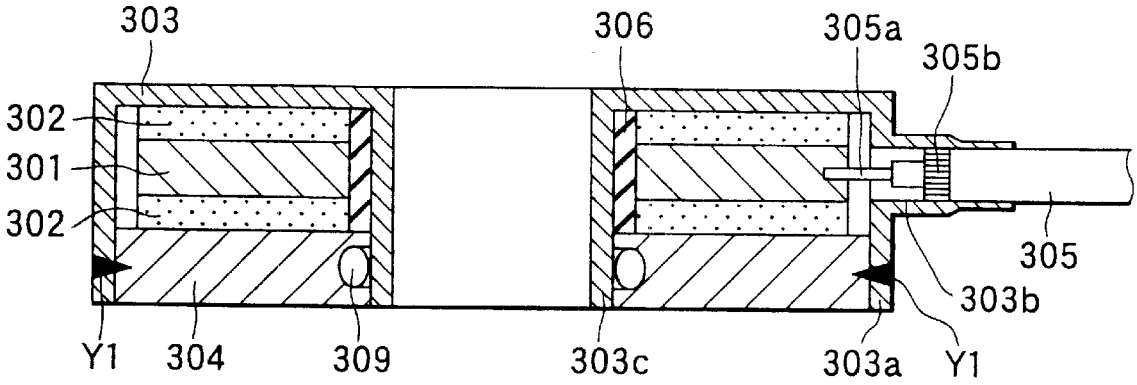
FIG. 2 is cross-sectional view of the pressure sensor for a glow plug according to the present invention.

As described above, unlike the prior art that has the pressure sensor in the interior of the housing, the described embodiment of the present invention provides a unique structure that has the pressure sensor arranged around the part of the central shaft 204, which protrudes from the other end of the housing 201, via the dielectric bush 209. With reference to FIG. 2, structural details of the pressure sensor 300 will now be described. FIG. 2 is an enlarged cross-sectional view of the pressure sensor 300 shown in FIG. 1.

In the pressure sensor 300, an annular electrode 301 is axially sandwiched by a couple of polarized annular piezoelectric ceramic bodies 302, electrically connected in parallel and made of lead titanate or lead zirconate titanate. The electrode 301 and the piezoelectric bodies 302 are axially sandwiched and are protectively packaged by a generally annular metal case 303 and a generally annular pedestal 304.

A protection tube 303*b* constituting a through hole of the metal case 303 is integrally connected with a large diameter section 303*a* of the metal case 303 by welding, brazing or the like. A shielded cable 305, which is used as an output line for conducting signals from the pressure sensor, is received in and supported by the tube 303*b*. A core conductor 305*a* of the shielded cable 305 is received in the metal case 303 and is welded to the electrode 301 to provide an electrical connection therewith. A shield conductor 305*b*, which is electrically insulated from the core conductor 305*a*, is caulked to the tube 303*b* to make an electrical connection with the metal case 303, which acts as an electrical ground.

The reason for electrically connecting the piezoelectric ceramic bodies 302 in parallel is to double an output sensitivity for improving a signal to noise ratio of the signal output. Alternatively, detection can be carried out by a single piezoelectric body. In such a case, a dielectric material must be placed on either the top or bottom side of the electrode 301. The metal case 303 is made of a sheet material having a thickness equal to or less than 0.5 mm to reduce the rigidity of the circumferential surface of the metal case 303 in order to ensure conductance of a small change induced by the combustion pressure to the piezoelectric ceramic bodies 302.

The pressure sensor 300 is assembled as follows. First, a heat shrinkable dielectric silicone tube 306 is received and heat shrunk around an outer circumferential surface of a small diameter section 303*c* of the metal case 303. Then, one of the piezoelectric ceramic bodies 302, the electrode 301 and other piezoelectric ceramic body 302 are sequentially received in the metal case 303 around the small diameter section 303*c*. The dielectric tube 306 prevents a short circuit between the metal case 303 and the piezoelectric ceramic bodies 302 as well as the electrode 301.

The electrode 301 arranged to be received in the metal case 303 has the core conductor 305*a* of the shielded cable 305 previously welded to it. The electrode 301 is received around the small diameter section 303*c* of the metal case 303 as the free end of the shielded cable 305 opposite to the welded end is inserted into and extends out of the protection tube 303*b*.

Then, the pedestal 304 having an O-ring 309 inserted therearound is received in the metal case 303. An outer circumferential surface of the pedestal 304 and an opposing circumferential surface of the metal case 303 are welded together (the weld is indicated by Y1 in FIG. 2) by a YAG laser while the metal case 303 and the pedestal 304 are axially pressed toward each other. As a result, structural integrity of the pressure sensor 300 is achieved, and all components of the sensor 300 are tightly packed together. Furthermore, since the shielded cable 305 and the protection tube 303*b* are effectively caulked together, the electrical connection between the shield conductor 305*b* and the metal case 303, the retention and securing of the shielded cable 305, as well as the sealing between the cable 305 and the tube 303*b* are achieved.

Therefore, the metal case 303, the pedestal 304 and the shield conductor 305*b* are all maintained at the same electrical potential, so that upon mounting the pressure sensor 300 to the plug main body 200, the pressure sensor 300 can be electrically grounded to the engine head 1. As a result, the completely closed and electrically sealed pressure sensor is provided.

An assembling operation of the glow plug 100 having the combustion pressure sensor in accordance with the present embodiment will now be described. First, the heating unit 206, which has the central shaft 204 previously received therein, and the housing 201, which has been metal plated, are provided. An outer diameter of the sheath tube 202 of the heating unit 206 is slightly larger than an inner diameter of the housing 201 (for example, a difference in these diameters may be in a range of +30 to +70 micrometers).

The sheath tube 202 of the heating unit 206 is press fitted into the housing 201, so that the sheath tube 202 and the housing 201 are securely and sealingly connected with each other due to their resiliencies. As a result, the housing 201, the central shaft 204 and the heating unit 206 are integrated together. Besides press fitting, the housing 201 and the heating unit 206 can be fully connected with each other by brazing, such as silver brazing. As a result, the gas-tightness of the interior of the housing 201 can be advantageously achieved.

Then, the washer 207 and the O-ring 208 are received around the central shaft 204 through the other end (on the terminal thread 204*a* side) of the central shaft 204. Thereafter, the pressure sensor 300 and the dielectric bush 209, located inside of the pressure sensor 300 are received around the central shaft 204 through the other end of the central shaft 204. The securing nut 210 is threadably tightened onto the terminal thread 204*a*, so that the pressure sensor 300 is securely held on the other end surface of the housing 201 (the end surface of the hexagon head section 201*a*). Next, the housing 201 is mounted in the engine head 1, and the connecting bar 2 is arranged on the top surface of the securing nut 210 around the terminal thread 204*a* and is secured by the terminal nut 211. The resulting structure is shown in FIG. 1.

Figure 3:
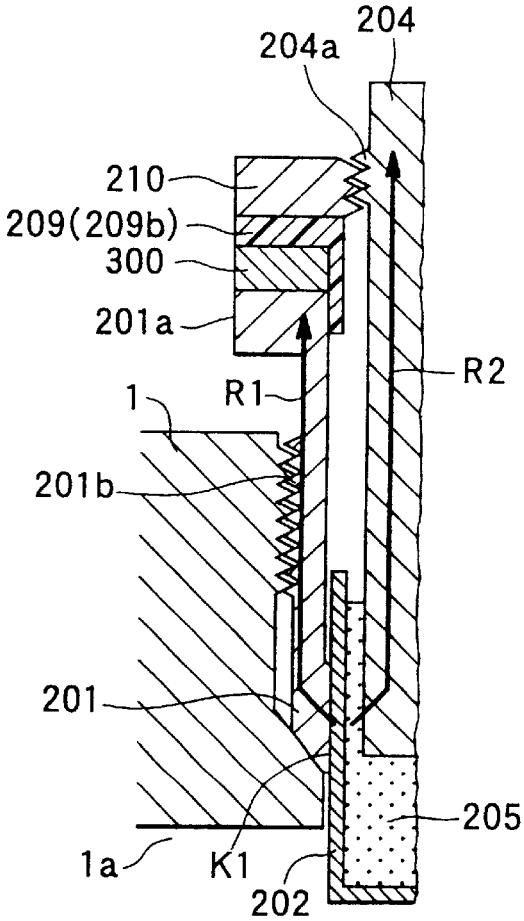
FIG. 3 is a descriptive view showing conducting paths for combustion pressure for a glow plug according to the present invention.

A mechanism for measuring the combustion pressure of the glow plug 100 according to the present embodiment will now be described with reference to FIGS. 1 to 3. FIG. 3 is a descriptive view (half cross-sectional view) of a simplified model showing conducting paths of the combustion pressure. In FIG. 1, the pressure sensor 300 is already securely held on the plug main body 200 by the securing nut 210. In this state, while the glow plug 100 is mounted in the engine head 1, the piezoelectric ceramic bodies 302 in the pressure sensor 300 are preloaded with a weight of 50 to 100 kg.

During engine start-up, a voltage is applied to the glow plug 100 through the connecting bar 2, and the plug 100 is electrically grounded to the engine head 1 through the central shaft 204, the heating coil 203, the sheath tube 202, the housing 201 and the mounting thread 201*b*. As a result, the heating unit 206 of the plug 100 is heated up to assist the ignition and start-up of the diesel engine. Once the engine is started, the combustion pressure generated in the engine is conducted through two paths R1, R2 indicated by solid bold lines and arrows in FIG. 3 and acts on the pressure sensor 300.

In the first path R1, the combustion pressure applied to the heating unit 206 is conducted to the housing 201 connected with the heating unit 206 and is then acts on the pressure sensor 300. The housing 201 itself is securely held by the engine head 1 via the mounting thread 201*b*. Therefore, the conduction of the force in the region above the mounting thread 201*b* in the first path R1 is largely disturbed, so that a positional change observed at the hexagon head section 201*a* of the housing 201 adjacent to the pressure sensor 300 becomes intrinsically very small.

On the other hand, in the second path R2, the combustion pressure applied to the heating unit 206 is conducted to the pressure sensor 300 through four components, i.e., the dielectric powder 205 filled in the heating unit 206, the central shaft 204, the securing nut 210 and the dielectric bush 209. In this path R2, these four components are completely free from disturbing factors, such as a component that substantially disturbs the positional change of the described four components.

The sheath tube 202 can move in an axial direction of the plug (upward and downward in FIG. 3) due to the resiliency or elasticity of the housing 201 even though the housing 201 and the sheath tube 202 are securely connected together at the secured region K1. Therefore, when the combustion pressure is conducted to the heating unit 206 through the second path R2, the sheath tube 202 and the central shaft 204 move integrally in an axial direction of the plug.

Therefore, the positional change at the hexagon head section 201*a* of the housing 201 in the first path R1 differs from the positional change at the central shaft 204 in the second path R2 (that is, the positional change in the second path R2 is larger than that in the first path R1). This difference in the positional changes causes reduction of the preload applied on the pressure sensor 300 from the securing nut 210.

Therefore, the load applied to the piezoelectric ceramic bodies 302 held within the pressure sensor 300 changes, causing a change in the generated electrical charge that is used as an electric signal indicating the combustion pressure and is output according to the piezoelectric characteristics of the piezoelectric ceramic bodies. The signal is output between the core conductor 305*a* (through the electrode 301 shown in FIG. 2) and the shield conductor 305*b* (constituting a ground return in corporation with the housing 201 acting as the ground, the mounting thread 201*b*, the metal case 303, the protection tube 303*b* and the pedestal 304) of the shielded cable 305.

Via the shielded cable 305, this output signal is supplied to a charge amplifier (not shown), which converts the generated electrical charge to a corresponding electrical voltage and amplifies it for further use. Then, the amplified signal is supplied to the ECU of an automobile (not shown). This electric signal indicating the combustion pressure can be used for combustion control of the engine. The mechanism for measuring the combustion pressure according to the present embodiment is thus described, and exemplary combustion pressure waveforms of the present embodiment will now be described with reference to FIG. 4.

Figure 4A:
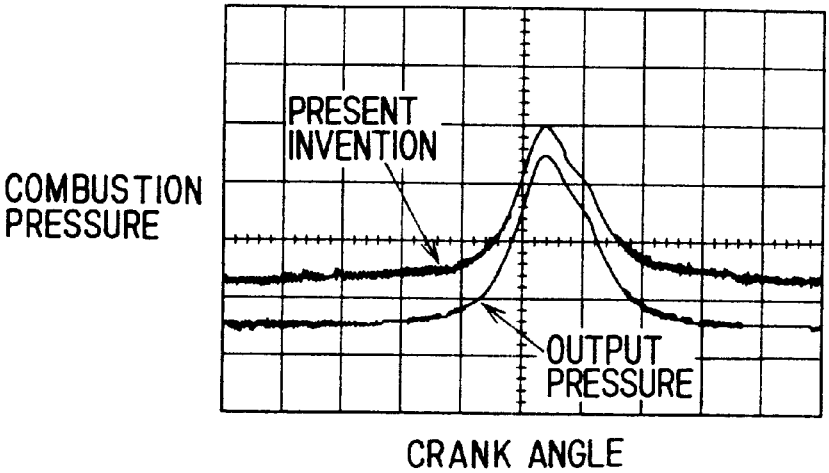
FIG. 4A is a graphical view showing combustion pressure waveforms according to the present invention.
Figure 4B:
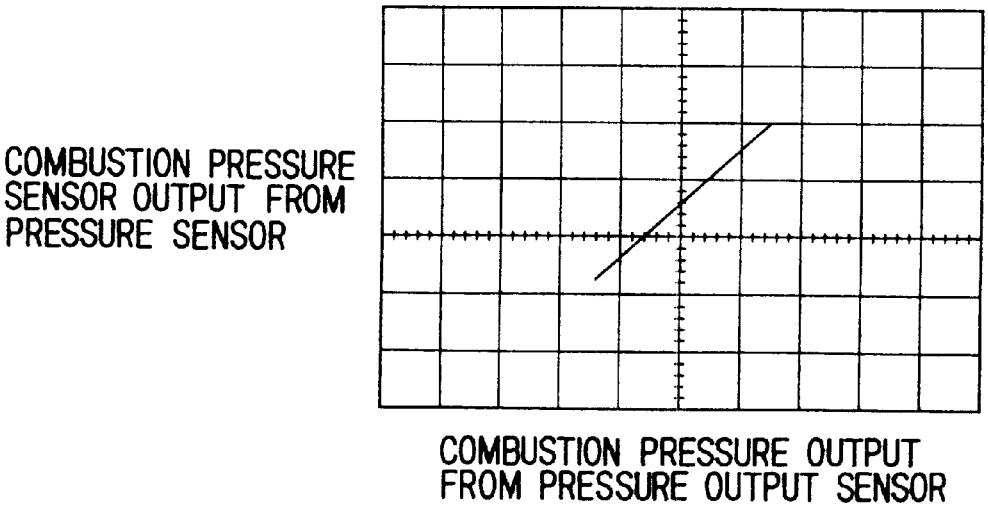
FIG. 4B is a graphical view showing combustion pressure waveforms according to the present invention.

FIGS. 4A and 4B show measured results of the glow plug 100 of FIG. 1 that are measured while the engine is running at the engine speed of 1200 rpm and the load of 40 N. FIG. 4A is a comparison graph showing combustion pressure waveforms of the engine measured with a pressure indicator and the pressure sensor 300 of the glow plug 100, respectively. FIG. 4B is a correlation diagram showing the combustion pressure outputs from the pressure sensor 300 of the glow plug 100 on a vertical axis and the combustion pressure outputs from the pressure indicator on a horizontal axis.

It will be understood from FIG. 4 that both the outputs from the pressure sensor 300 of the glow plug 100 and the outputs from the pressure indicator show generally the same type of waveform, and the correlation diagram shows a substantially linear relationship between the outputs from the pressure sensor 300 of the glow plug 100 and the outputs from the pressure indicator over both the pressure rising and falling periods. This fact indicates that a change in the load applied to the pressure sensor 300 in response to the combustion pressure change in the engine can be adequately measured by the glow plug 100 of the present invention.

In the described embodiment, since the internal surface of the housing 201 and the external surface of the sheath tube (pipe member) 202 are secured with each other at the one end side of the housing 201, which is exposed to the combustion gas, without forming a substantial gap between them by means of the press fitting or the brazing, the gas tightness of the interior of the housing 201 against the combustion gas can be achieved. Therefore, the combustion gas from the combustion chamber 1*a* does not penetrate into he housing 201, so that the deterioration of the pressure sensor 300 due to the exposure to the combustion gas and the disconnection of the heating coil 203 can be effectively prevented, resulting in the durable glow plug having the combustion pressure sensor.

Furthermore, in the described embodiment, the pressure sensor 300 is arranged around the part of the central shaft 204, which protrudes from the other end of the housing 201. Therefore, the pressure sensor 300 is arranged outside of the housing 201. As a result, the shielded cable 305 acting as the output line can simply and directly be connected to the pressure sensor 300. Unlike the prior art, the relatively complicated wiring structure for extending the output line of the combustion pressure sensor out of the housing is no longer required. As a result, both the gas tightness of the housing interior and the simplification of the wiring structure for the output line of the combustion pressure sensor are achieved in accordance with the present embodiment.

Figure 5:
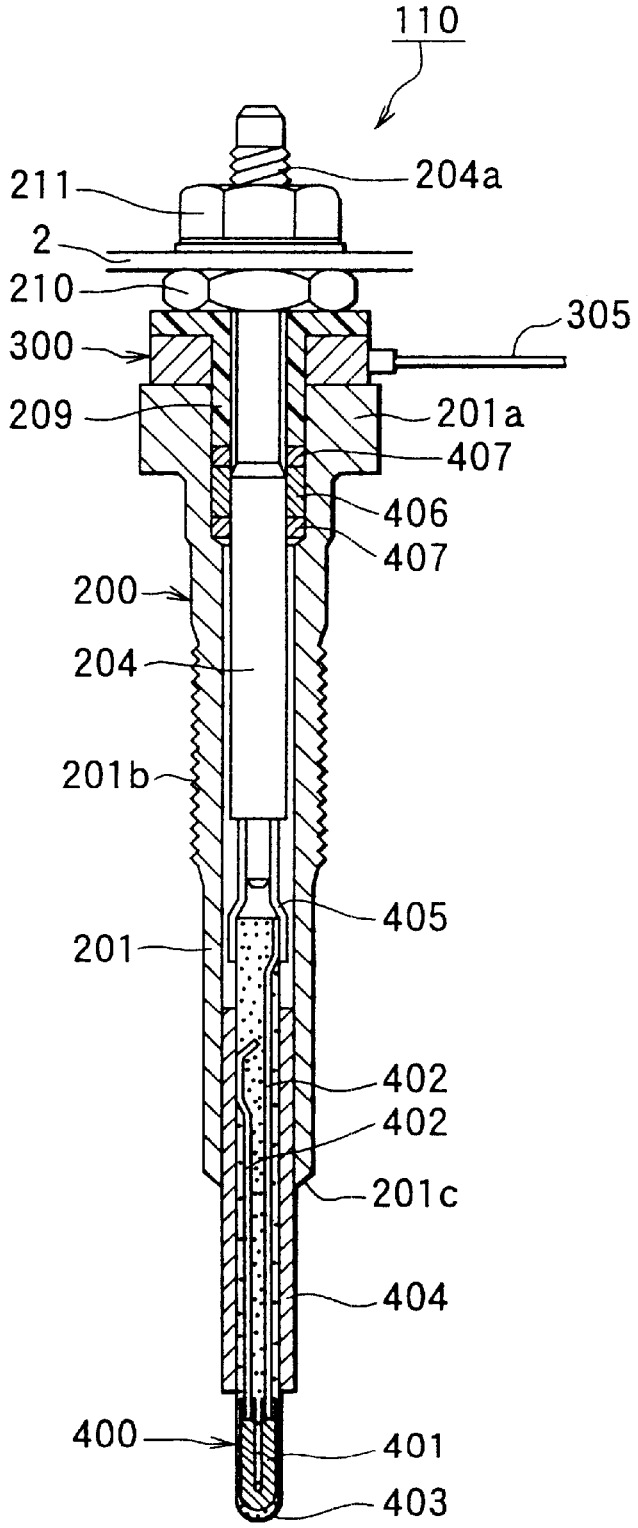
FIG. 5 is a cross-sectional view of a modified version of the glow plug of the first embodiment of the present invention.

In this embodiment, besides the metal heating unit having the metal resistance wire (heating coil 203) described with reference to FIG. 1, any other type of suitable heating unit, such as the heating unit shown in FIG. 5, can be used. FIG. 5 is a cross-sectional view of a modified version of the glow plug 110. The heating unit 400 shown in FIG. 5 is a ceramic heating unit. The heating unit 400 has a heating body 401 made of an electrically conductive ceramic material including silicon nitride and molybdenum silicide, and has a pair of lead wires 402 made of tungsten, and a sintered dielectric ceramic body 403 including silicon nitride and covering the heating body 401 and the lead wires 402.

The heating unit 400 is received and held in a cylindrical protective pipe (the pipe member of the present invention) 404 made, for example, of a non-corrosive heat resistant metal alloy (such as SUS 430). The heating unit 400 protrudes from one end of the protective pipe 404. The other end of the protective pipe 404 is received in the one end side of the housing 201. The internal surface of the housing 201 and an external surface of the protective pipe 404 are secured with each other by the press fitting, brazing or the like without forming a substantial gap between them in a manner similar to the one discussed with reference to the sheath tube.

One of the lead wires 402 is electrically connected to a central shaft 204 via a cap lead 405 connected to the one end of the central shaft 204. The other lead wire 402 is electrically grounded to the housing 201 via the protective pipe 404. With this arrangement, the central shaft 204 is electrically connected to the heating body 401, and the heating unit 400 is heated upon energization of the heating body 401. Fused glass 406 and an insulator 407 are arranged between the central shaft 204 and the housing 201 for holding, securing and centering the central shaft 204. The glow plug 110 has substantially the same advantages as those of the glow plug 100 discussed with reference to FIG. 1 except that the glow plug 110 also has the relatively lower output sensitivity.

Figure 6:
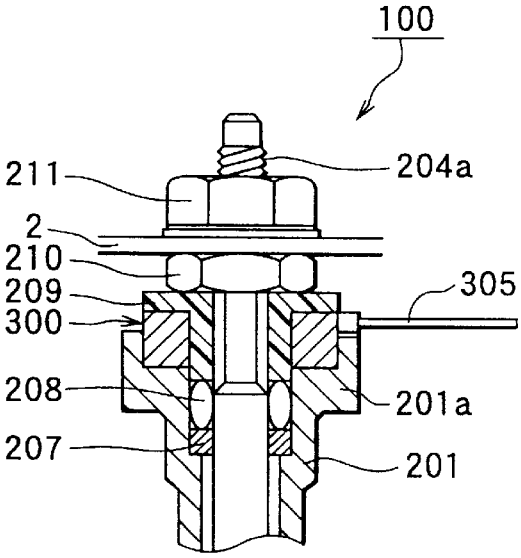
FIG. 6 is a cross-sectional view of a pressure sensor for a glow plug according to the present invention.

In the described embodiment, the pressure sensor 300 can be similar to a modified version shown in FIG. 6. In FIG. 6, the pressure sensor 300 does not abut the end surface of the hexagon head section 201*a* but is embedded in the hexagon head section 201*a* to restrict both the axial and radial movements of the pressure sensor 300. Therefore, a lateral sliding movement of the pressure sensor 300 due to engine vibrations is effectively limited, so that mechanical vibrational noises, for example, of the central shaft 204 are reduced, and therefore a signal to noise ratio is improved for the measurement of the combustion pressure.

Figure 7:
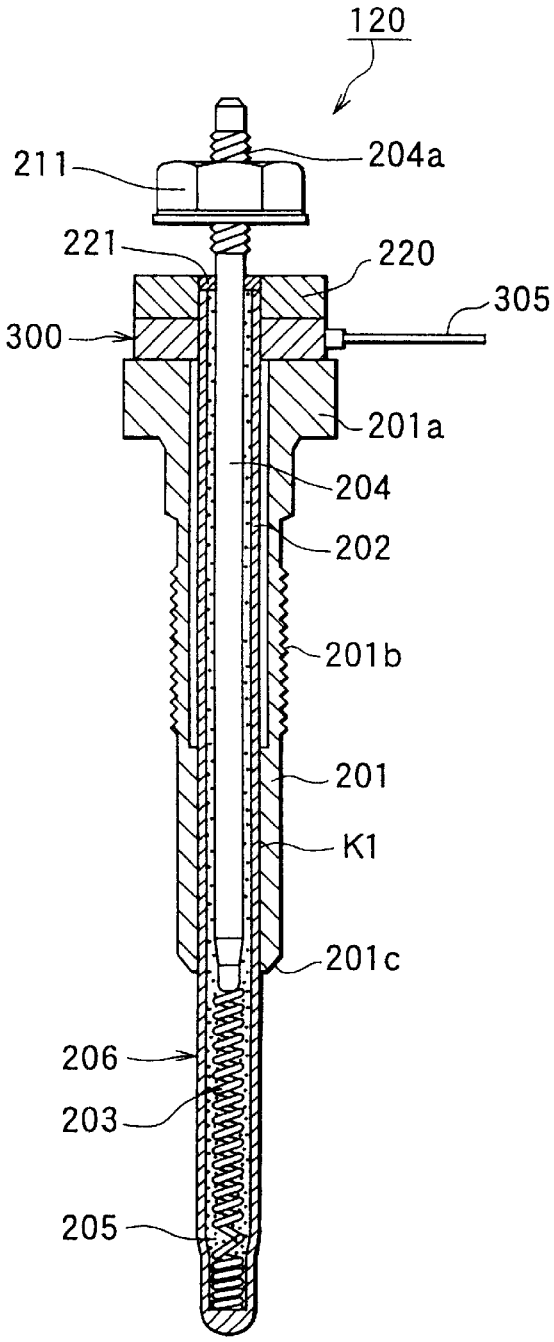
FIG. 7 is a cross-sectional view of a glow plug having a combustion pressure sensor in accordance with a second embodiment of the present invention.

FIG. 7 is a cross-sectional view of a glow plug 120 having a combustion pressure sensor in accordance with a second embodiment of the present invention. The second embodiment is similar to the first embodiment except for the manner that the pressure sensor 300 is secured. The following description will focus on certain differences between the two embodiments, and the components that are similar in nature to those described with respect to the first embodiment are represented by the same numerals as used for the first embodiment. Although, the engine head is not shown in FIG. 7 for the sake of clarity, the glow plug 120 is threadably received in the corresponding threaded hole of the engine head, and the heating unit 206 side of the glow plug 120 is exposed to the combustion chamber as in FIG. 1.

In the present embodiment, the sheath tube 202, which is secured to the one end side (on the bottom side of FIG. 7) of the housing 201 in the secured region K1, has one end exposed from the one end of the housing 201 and also has other end exposed from the other end (on the top side of FIG. 7) of the housing 201. A sealing 221 made, for example, of a silicone resin or rubber material for sealing the dielectric powder 205 received in the sheath tube 202 is arranged around the other end side of the central shaft 204 that protrudes from the other end of the sheath tube 202.

In this embodiment, the pressure sensor 300 is located on the end surface of the hexagon head section 201*a* of the housing 201. This arrangement allows easy insertion of the pressure sensor 300 around the other end of sheath tube 202. An annular stop ring 220 made of a metal material is press fitted around the other end of the sheath tube 202 to sandwich the pressure sensor 300 between the stop ring 220 and the hexagon head section 201*a*, securely holding the pressure sensor 300 on the housing 201. An inner diameter of the stop ring 220 is made to be smaller than an outer diameter of the other end of the sheath tube 202 by an amount ranging from, for example, −30 to −70 micrometers to allow the press fitting.

In FIG. 7, the connecting bar for energizing the glow plug is not illustrated for the sake of clarity but is actually present around the terminal thread 204*a* of the central shaft 204 between the stop ring 220 and the terminal nut 211. The connecting bar is secured around the central shaft 204 by threadably tightening the terminal nut 211 onto the terminal thread 204*a*. Similar to the first embodiment, the glow plug 120 can assist the ignition of the engine.

As described above, in accordance with the present embodiment, the dielectric bush, the O-ring and the washer provided in the first embodiment are not required, so that the structure of the glow plug is simplified, and therefore the conducting paths of the combustion pressure are also simplified. Furthermore, the components conducting the combustion pressure in the first embodiment are replaced with the components having higher rigidities in this embodiment, so that a higher output sensitivity of the combustion pressure is expected, as detailed below.

As shown in FIG. 3, the conducting path (second path R2) of the combustion pressure in the glow plug shown in FIG. 1 runs through the heating unit 206, the dielectric powder 205, the central shaft 204, the securing nut 210, the dielectric bush 209 and the pressure sensor 300. Especially, when the combustion pressure is conducted to the central shaft 204, the combustion pressure is conducted through the ceramic powder, which has the rigidity lower than that of the solid metal, so that the conduction loss in the ceramic powder is supposed to be larger than that in the solid metal.

On the other hand, the conducting path (second path R2) of the combustion pressure in the glow plug 120 of the present embodiment runs through the heating unit 206, the stop ring 220 and the pressure sensor 300. Therefore, in this embodiment, the number of the components in the conducting path is less than that of the first embodiment, and the conduction loss and the rigidity of the sheath tube 202 are far better than those of the dielectric powder.

In this embodiment, the positional change at the hexagon head section 201*a* of the housing 201 in the first path (running through the heating unit 206, the housing 201 and the pressure sensor 300) differs from the positional change at the sheath tube 202 in the second path. This difference in the positional change causes reduction of the pre-load applied on the pressure sensor 300 from the stop ring 220, allowing measurement of the combustion pressure.

In this embodiment, similar to the first embodiment, there are advantages of securing the internal surface of the housing 201 and the external surface of the sheath tube 202 with each other by the press fitting or the brazing without forming a substantial gap between them. Furthermore, there are also the advantages of arranging the pressure sensor 300 outside of the housing 201 by positioning the pressure sensor 300 around the part of the central shaft 204, which protrudes from the other end of the housing 201, via the sheath tube 202.

besides the press fitting or the brazing, the internal surface of the housing 201 and the external surface of the pipe member 204, 404 can be secured with each other at the one end side of the housing 201 by any other suitable means, such as welding, thread engagement or the like.

Furthermore, in FIG. 1 and FIGS. 5–7, although the pressure sensor 300 directly abuts and is electrically grounded to the other end surface (the end surface of the hexagon head section 201*a*) of the housing 201, a rigid spacer member (such as one made of a metal or dielectric material) can be positioned between the pressure sensor 300 and the housing 201 as long as the pressure sensor 300 is electrically grounded to the housing 201.

The combustion pressure sensor needs not to be the piezoelectric pressure sensor and can be, for example, a semiconductor pressure sensor as long as it measures the combustion pressure of the internal combustion engine based on the load.

While the above-described embodiments refer to examples of usage of the present invention, it is understood that the present invention may be applied to other usage, modifications and variations of the same, and is not limited to the disclosure provided herein.

What is claimed is:

1. A glow plug comprising:

a cylindrical housing mounted in an internal combustion engine, one end side of said cylindrical housing being positioned at a combustion chamber side of said internal combustion engine;

a cylindrical pipe member held in said housing such that one end side of said cylindrical pipe member is exposed from said one end side of the housing, said cylindrical pipe member being inserted into said one end side of the housing and affixed to said housing;

a heating member disposed in said pipe member, wherein said heating member is heated up upon energization;

a metal central shaft received in said housing such that part of said central shaft protrudes from an opposite end of said housing from said one end side, wherein said central shaft is electrically connected with said heating member and fixed relative to said pipe member via heat resistant dielectric powder;

an internal surface of said housing and an external surface of said pipe member being secured together without forming a substantial gap between them at said one end side of the housing; and a combustion pressure sensor disposed around said protruding part of said central shaft to measure combustion pressure in said internal combustion engine based on a force acting on said pipe member and transmitted therefrom to said central shaft upon development of said combustion pressure, wherein a force developed between said central shaft and said housing is transmitted to said pressure sensor.

2. A glow plug as in claim 1, wherein said internal housing surface and said external pipe member surface are secured together by press fitting, wherein said press fitting maintains said pipe member and said external surface without a substantial gap.

3. A glow plug as in claim 1, wherein said internal housing surface and said external pipe member surface are secured together by brazing, wherein said brazing maintains said pipe member and said external surface without a substantial gap.

4. A glow plug as in claim 1, wherein said pipe member is secured directly to said housing.

5. A glow plug as in claim 1 wherein the pressure sensor has an outside diameter that is smaller than the largest outside diameter of the glow plug.

6. A glow plug as in claim 1, wherein combustion pressure applied to said pipe member is transmitted to said housing connected with the pipe member and from there to said pressure sensor.

7. A glow plug as in claim 1, wherein combustion pressure applied to said pipe member is transmitted to said central shaft connected and then acts on said pressure sensor.

8. A glow plug as in claim 1, wherein combustion pressure applied to said pipe member is transmitted simultaneously via said housing and via said central shaft to act on said pressure sensor.

9. A glow plug for an internal combustion engine, said glow plug comprising:

a cylindrical housing for mounting in an internal combustion cylinder head, said cylindrical housing having a first end and a second end, wherein said first end is adapted to protrude within a combustion chamber defined by said internal combustion engine and said second end is adapted to protrude above said cylinder head on a side opposite said internal combustion chamber;

a cylindrical pipe member having a first end and a second end, said first end adapted to protrude into said combustion chamber and said second end being fixed within said first end of said cylindrical housing, wherein said cylindrical pipe member is fixedly secured by a press-fit within said cylindrical housing and a portion of the pipe member within the housing has a single consistent diameter;

a heating member arranged in said pipe member, wherein said heating member increases in temperature upon application of energy;

a central shaft received in said cylindrical housing such that part of said central shaft protrudes above said cylinder head on a side opposite said internal combustion chamber, wherein said cylindrical pipe member and said central shaft are fixed relative to each other by an intervening heat resistant dielectric powder, said central shaft being electrically connected to said heating member; and a combustion pressure sensor disposed to interact with said part of said central shaft protruding from said opposite end of said housing so as to measure combustion pressure in said combustion chamber acting on said pipe member and transmitted to the central shaft from said pipe member.

10. A glow plug as in claim 9 wherein the pressure sensor outside diameter is smaller than the largest outside diameter portion of the glow plug.

11. A glow plug as in claim 9 wherein a pressure difference between said central shaft and said housing is transmitted to said pressure sensor.

12. A glow plug as in claim 11 wherein combustion pressure applied to said pipe member is transmitted to said housing and then to said pressure sensor.

13. A glow plug as in claim 11 wherein combustion pressure applied to said pipe member is transmitted to said central shaft and then to said pressure sensor.

14. A glow plug as in claim 9 wherein said cylindrical pipe member has an outside diameter not larger than an inside diameter of said housing, the cylindrical pipe member being inserted directly into said one end of said cylindrical housing to create a press fit therewith.

15. A glow plug including a combustion pressure sensor for an internal combustion engine, said glow plug comprising:

a housing adapted for affixation to an internal combustion engine with a distal first end extending into an engine combustion chamber and a proximal opposite second end extending outside said combustion chamber;

a pipe having a distal closed end with an electric heating element therein and said pipe also having a proximal open end immovably affixed to said distal first end of the housing;

a central metal shaft disposed within said housing electrically connected to said heating element, a distal end of said central shaft being mechanically coupled to a distal portion of said pipe, said central shaft also having a proximal end which extends outwardly beyond the proximal end of the housing; and a pressure-to-electrical transducer disposed to experience a force developed between said housing and said central shaft in response to combustion pressure within the combustion chamber.

16. A glow plug as in claim 15 wherein said transducer is electrically insulated from said central shaft.

17. A method for sensing combustion pressure in an internal combustion engine using a glow plug, said method comprising:

affixing a housing to an internal combustion engine with a distal first end extending into an engine combustion chamber and a proximal opposite second end extending outside said combustion chamber;

immovably affixing the proximal end of a pipe to said distal first end of the housing, said pipe having a closed distal end containing an electric heating element;

disposing a metal central shaft within said housing and electrically connecting a distal portion of the shaft to said heating element, a distal end of said central shaft being mechanically coupled to a distal portion of said pipe, said central shaft also having a proximal end which extends outwardly beyond the proximal end of the housing; and disposing a pressure-to-electrical transducer so as to experience a force developed between said housing and said central shaft in response to combustion pressure within the combustion chamber.

18. A method as in claim 17 wherein said transducer is electrically insulated from said central shaft.

* * * * *